US006673211B2

(12) United States Patent
Doelle

(10) Patent No.: US 6,673,211 B2
(45) Date of Patent: Jan. 6, 2004

(54) APPARATUS FOR LOADING FIBERS IN A FIBER SUSPENSION WITH CALCIUM CARBONATE

(75) Inventor: Klaus Doelle, Menasha, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 8 days.

(21) Appl. No.: 09/902,975

(22) Filed: Jul. 11, 2001

(65) Prior Publication Data

US 2003/0010463 A1 Jan. 16, 2003

(51) Int. Cl.[7] ..... D21C 9/00

(52) U.S. Cl. ..... 162/261; 162/23; 162/24; 162/26; 162/9; 241/261.2; 422/226; 422/232; 422/233

(58) Field of Search ..... 162/23, 26, 24, 162/261, 9; 241/261.2; 422/226, 232, 233

(56) References Cited

U.S. PATENT DOCUMENTS

| | | | | | |
|---|---|---|---|---|---|
| 4,082,233 | A | * | 4/1978 | Reinhall | 162/23 |
| 4,684,073 | A | * | 8/1987 | Berggren | 162/261 |
| 4,954,221 | A | * | 9/1990 | Reinhall et al. | 162/23 |
| 5,223,090 | A | | 6/1993 | Klungness et al. | 163/2 |
| 6,073,865 | A | * | 6/2000 | Kriebel et al. | 162/23 |
| 6,227,471 | B1 | * | 5/2001 | Virving | 241/244 |
| 2002/0112826 | A1 | * | 8/2002 | Kriebel et al. | 167/23 |

* cited by examiner

*Primary Examiner*—Peter Chin
(74) *Attorney, Agent, or Firm*—Taylor & Aust, P.C.

(57) ABSTRACT

An apparatus for loading fibers in a fiber suspension with calcium carbonate has a housing with an inlet and an accept outlet. A rotatable distribution member is positioned within the housing. A rotor and stator assembly is positioned within the housing radially outside of the distribution member. A toothed ring is interposed between the distribution rotor and the rotor and stator assembly. The toothed ring and the rotor and stator assembly define a gas ring therebetween. A reactant gas supply is fluidly coupled with the gas ring.

21 Claims, 2 Drawing Sheets

APPARATUS FOR LOADING FIBERS IN A FIBER SUSPENSION WITH CALCIUM CARBONATE

BACKGROUND OF THE INVENTION

1. Field of the Invention

The present invention relates to an apparatus for loading fibers in a fiber suspension with a chemical compound, and, more particularly, to an apparatus for loading fibers in a fiber suspension with calcium carbonate.

2. Description of the Related Art

A paper-making machine receives a fiber suspension including a plurality of fibers, such as wood fibers, which are suspended within an aqueous solution. The water is drained and the fiber suspension, of more than 2,200 cu. ft. up to 132,000 cu. ft. per day for today's paper making process, which is dried in the paper-making machine to increase the fiber content and thereby produce a fiber web as an end product.

The fiber web produced by the paper-making machine typically includes organic wood fibers and inorganic fillers. A known inorganic filler is calcium carbonate, which may be added directly to the fiber suspension (direct loaded calcium carbonate). It is also known to chemically load the fibers within a fiber suspension with calcium carbonate in the lumen and walls of the individual fibers (fiber loaded calcium carbonate). The fiber loaded calcium carbonate increases the strength of the paper compared with a direct loaded calcium carbonate (adding calcium carbonate directly to the fiber suspension) at the same loading (filler) level. This yields an economic advantage in that the filler level of the paper is increased by replacing the more expensive fiber source (wood fibers) with calcium carbonate. The finished paper web has higher strength properties due to the increased filler levels of the calcium carbonate. In contrast, the strength properties of a finished web using direct loaded calcium carbonate is less.

For example, U.S. Pat. No. 5,223,090 (Klungness, et al.) discloses a method for chemically loading a fiber suspension with calcium carbonate. In one described method, calcium oxide or calcium hydroxide is placed within a refiner unit and carbon dioxide is injected into the refiner unit at a specified pressure. The fiber suspension is maintained within the refiner for a predetermined period of time to ensure that a proper chemical reaction and thus proper chemical loading of the fiber suspension occurs. In another described method, a fiber suspension with calcium oxide or calcium hydroxide is introduced into a 20 quart food mixer and carbon dioxide gas is injected into the mixer at a specified pressure. Using either the refiner or the food mixer, both methods utilize a batch processing method for processing only a small amount of the fiber suspension at a time. Because of the large amount of fiber suspension which is required at the wet end of a paper-making machine, a batch process requires that the chemically loaded fiber suspension be transferred to another holding tank for ultimate use in a paper-making machine.

What is needed in the art is an apparatus for chemically loading a fiber suspension for use in a paper-making machine with an adequate output of a chemically loaded fiber suspension which allows commercialization of such a chemical loading process.

SUMMARY OF THE INVENTION

The present invention provides an apparatus for continuously loading fibers in a fiber suspension with calcium carbonate using a distribution cross, a toothed ring, a gas ring, and a rotor and stator assembly. The toothed ring controls the flow of the pulp and lime mixture and/or pulp lime mixture through the gas ring, where a chemical reaction forming calcium carbonate occurs. The rotor and stator assembly distributes the calcium carbonate within the fiber suspension.

The invention comprises, in one form thereof, an apparatus for loading fibers in a fiber suspension with calcium carbonate, including a housing having an inlet and an accept outlet. A rotatable distribution member is positioned within the housing. A rotor and stator assembly is positioned within the housing radially outside of the distribution member. A toothed ring is interposed between the distribution rotor and the rotor and stator assembly. The toothed ring and the rotor and stator assembly define a gas ring therebetween. A reactant gas supply is fluidly coupled with the gas ring.

An advantage of the present invention is that the apparatus provides for fiber loading of the fiber suspension in a continuous manner, thereby providing output quantities of loaded fiber suspension sufficient for commercial use in a paper-making machine Another advantage is that the distribution member as well as the rotor are driven by a common input shaft.

Yet another advantage is that the toothed ring may be configured to control the flow rate of the pulp and lime mixture and/or pulp lime mixture into the gas ring.

A further advantage is that the rotor and stator assembly adequately distributes the calcium carbonate crystals within the fiber suspension.

A still further advantage is that variables such as flow rate, temperature and pressure which affect the fiber loading process can be accommodated and varied with the fiber loading apparatus of the present invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
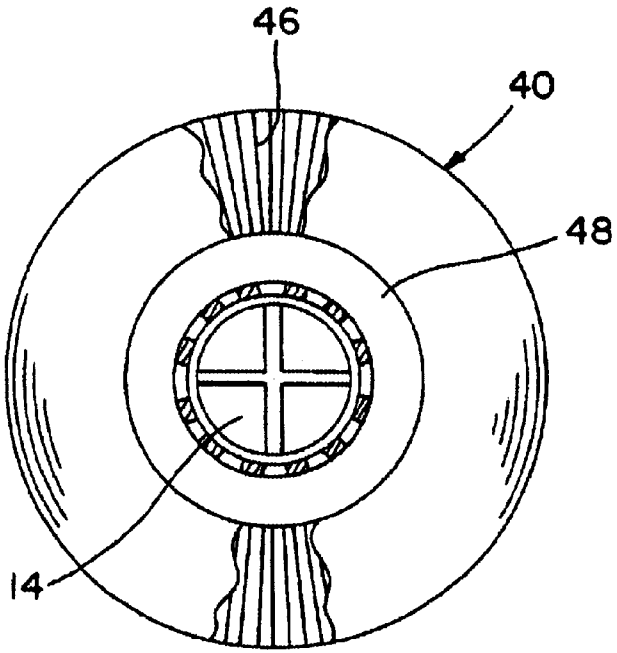
FIG. 2 is a sectional view of the fiber loading apparatus shown in FIG. 1, taken along line 2—2.
Figure 1:
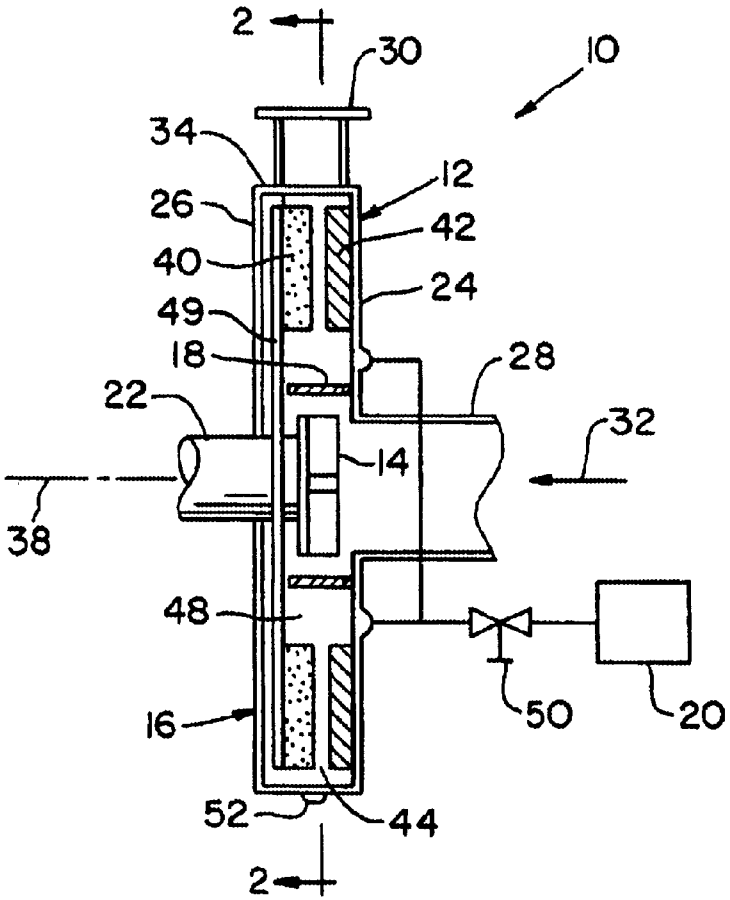
FIG. 1 is a sectional view of an embodiment of a fiber loading apparatus of the present invention.

Referring now to the drawings, and more particularly to FIGS. 1 and 2, there is shown an embodiment of a fiber loading apparatus 10 of the present invention for loading fibers in a fiber suspension with calcium carbonate. Fiber loading apparatus 10 generally includes a housing 12, rotatable distribution member 14, rotor and stator assembly 16, toothed ring 18, reactant gas supply 20 and input shaft 22.

Housing 12 includes two annular shaped walls 24 and 26, an inlet 28 and an accept outlet 30. Inlet 28 is in the form of an inlet pipe which receives a pulp and lime mixture, as indicated by arrow 32. The lime may be in the form of calcium hydroxide and/or calcium oxide, as will be described in more detail hereinafter. Inlet pipe 28 is coupled with an opening formed in annular wall 24 to provide the pulp and lime mixture to the interior of housing 12. Accept outlet 30 is coupled with and extends from peripheral wall 34 extending between annular walls 24 and 26.

Figure 3:
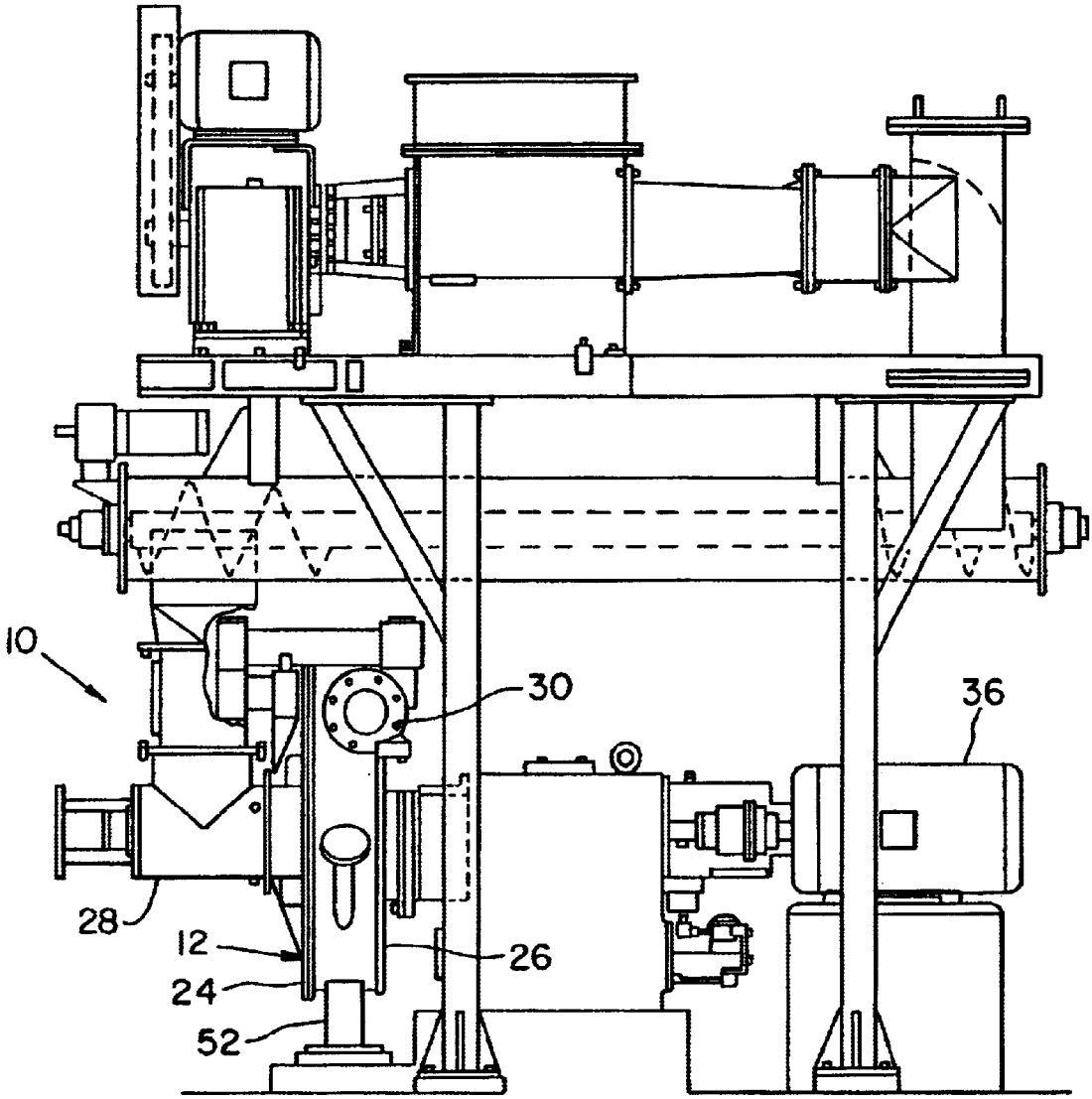
FIG. 3 is a side view of the fiber loading apparatus shown in FIGS. 1 and 2, incorporated within a fiber loading system.

Rotatable distribution member 14 is in the form of a distribution cross in the embodiment shown, having a plurality (namely four) radially extending paddles which distribute the pulp and lime mixture and/or pulp lime mixture received from inlet pipe 28 in a radially outward direction. Distribution cross 14 is concentrically coupled with input shaft 22, which in turn is rotatably driven via an electric motor 36 (FIG. 3). Distribution cross 14 having at least 2 to 8 paddles, preferably 4, and input shaft 22 thus each have a common axis of rotation 38. Distribution cross 14 is also positioned generally concentric with inlet pipe 28 so as to evenly distribute the pulp and lime mixture in a radially outward direction within housing 12.

Rotor and stator assembly 16 includes a rotor 40 and a stator 42. Stator 42 is attached to and carried by annular wall 24. Rotor 40 is positioned in opposed relationship relative to stator 42 to define a gap 44 therebetween. The distance of gap 44 between rotor 40 and stator 42 is between approximately 0.5 and 100 mm, preferably between approximately 25 and 75 mm. Each of rotor 40 and stator 42 have an outside diameter of between 0.5 and 2 meters, resulting in a tangential velocity at the outside diameter of rotor 40 of between 20 and 100 meters per second, preferably between 40 and 60 meters per second, at the rotational speed of input shaft 22. Rotor 40 and stator 42 each include a plurality of teeth, in known manner. The gap distance between rotor 40 and stator 42, as well as the particular configuration of the teeth design of rotor 40 and stator 42, may vary, depending upon the particular application.

Rotor 40 and input shaft 22 are coupled together via disk 49. Rotor 40 is coupled with disk 49 such that rotor 40 is generally concentric about axis of rotation 38.

Toothed ring 18 is attached to annular wall 24 and extends towards annular wall 26 in a direction generally parallel to axis of rotation 38. Toothed ring 18 is interposed between distribution member 14 and rotor and stator assembly 16. Toothed ring 18 includes a plurality of teeth 46 (shown in cross section in FIG. 2) which are annularly spaced relative to each other. Teeth 46 may have a generally rectangular cross-sectional shape as shown or may be differently shaped, depending upon the particular application. The size of teeth 46, as well as the spacing between teeth 46, is selected to control the rate of flow of the fiber suspension in a radially outward direction from distribution member 14, depending upon operating conditions such as pressure, etc.

Toothed ring 18 and rotor and stator assembly 16 define a gas ring 48 therebetween. Gas ring 48 is annular shaped and extends between toothed ring 18 and rotor and stator assembly 16. The size of gas ring 48, defined primarily in terms of the radial expanse of gas ring 48, is pertinent to the reaction time of the chemical reaction which occurs within gas ring 48, as will be described hereinafter.

Reactant gas supply 20 is fluidly coupled with gas ring 48 at a plurality of locations. Gas supply 20 supplies a reactant gas, such as carbon dioxide, ozone and/or steam to gas ring 48. A control valve 50 is coupled with reactant gas supply 20 and controls a pressure and/or flow rate of the reactant gas which flows into gas ring 48. In the embodiment shown, reactant gas supply 20 is in the form of a carbon dioxide gas supply.

Dilution water inlet 52 is coupled with peripheral wall 34. Dilution water inlet 52 is coupled with a source of dilution water and is used to dilute the fiber suspension to a desired consistency prior to discharge from accept outlet 30.

During use, a fiber suspension in the form of a pulp and lime mixture and/or pulp lime mixture is transported through inlet pipe 28 to the interior of housing 12. The fiber suspension has a fiber consistency of between approximately 2.5% and 60% at inlet pipe 28, and preferably has a consistency of between approximately 15% and 35% at inlet pipe 28. The lime may include calcium hydroxide and/or calcium oxide, and preferably includes calcium hydroxide at a concentration of between 0.1% and 60% dry weight before being mixed with the fiber suspension, more preferably has a concentration of between 2% and 20% dry weight before being mixed with the fiber suspension.

Distribution cross 15 distributes the fiber suspension in a radially outward direction toward toothed ring 18. Toothed ring regulates the flow of the fiber suspension into gas ring 48.

A reactant gas, such as carbon dioxide, ozone and/or steam, preferably carbon dioxide, is injected into gas ring 48 from reactant gas supply 20. The carbon dioxide is injected into gas ring 48 at a temperature between approximately −15° C. and 120° C., preferably at a temperature between approximately 20° C. and 90° C. Moreover, the carbon dioxide is injected into gas ring 48 at a pressure of between approximately 0.1 and 6 bar, preferably between approximately 0.5 and 3 bar. The fiber suspension has a pH within gas ring 48 of between approximately 6.0 and 10 pH, preferably between approximately 7.0 and 8.5 pH. The temperature and pressure of the carbon dioxide gas, the pH of the fiber suspension, and reaction time within gas ring 48, primarily determine the type of calcium carbonate crystals which are formed as a result of a chemical reaction between the carbon dioxide and the lime in the fiber suspension. The calcium carbonate crystals have a rombohedral, scalenohedral or sphere shape, depending upon these operating conditions. The calcium carbonate crystals are loaded into the lumen as well as on the walls of the individual fibers within the fiber suspension. The formed calcium carbonate crystals have a size distribution of between approximately 0.05 and 5 micrometers, preferably of between 0.3 and 2.5 micrometers.

The loaded fiber suspension then flows from gas ring 48 through rotor and stator assembly 16. More particularly, the fiber suspension flows through gap 44, as well as the spaces between adjacent teeth 46 of rotor 40 and stator 42. Rotor and stator assembly 16 distributes the calcium carbonate crystals in the fiber suspension. The fiber suspension has a pulp consistency of between approximately 0.1% and 50% when passing through rotor and stator assembly 16, and preferably has a pulp consistency of between approximately 2.5% and 35%. The fiber suspension, loaded with calcium carbonate crystals on and in the individual fibers within the fiber suspension, is discharged through accept outlet 30 to atmospheric pressure for further processing, such as to a machine or chest.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for loading fibers in a fiber suspension with calcium carbonate, comprising:

a housing having an inlet and an accept outlet;

a rotatable distribution member positioned within said housing;

a rotor and stator assembly positioned within said housing radially outside of said distribution member, including a rotor and stator in opposed relationship defining a gap therebetween, said gap being between approximately 0.5 mm and 100 mm;

a toothed ring interposed between said distribution member and said rotor and stator assembly, said toothed ring and said rotor and stator assembly defining a gas ring therebetween; and a reactant gas supply fluidly coupled with said gas ring.

2. The fiber loading apparatus of claim 1, further including a rotatable input shaft, each of said distribution member and said rotor being coupled with and driven by said input shaft.

3. The fiber loading apparatus of claim 2, each of said distribution member and said rotor being generally concentric with said input shaft.

4. The fiber loading apparatus of claim 1, said distribution member comprising a distribution cross with a plurality of radially extending paddles.

5. The fiber loading apparatus of claim 1, said inlet comprising an inlet pipe and said distribution member positioned generally concentric with said inlet pipe.

6. The fiber loading apparatus of claim 1, said distribution member having an axis of rotation, and said toothed ring being annular shaped with a plurality of teeth extending generally parallel to said axis of rotation and annularly spaced apart from each other.

7. The fiber loading apparatus of claim 6, said teeth having a generally rectangular cross-sectional shape.

8. The fiber loading apparatus of claim 1, said reactant gas supply coupled with said housing and in fluid communication with said gas ring at a plurality of locations.

9. The fiber loading apparatus of claim 8, including a control valve coupled with said reactant gas supply for controlling at least one of a pressure and flow rate of a reactant gas into said gas ring.

10. The fiber loading apparatus of claim 1, said housing including two annular shaped walls, said stator and said toothed ring coupled with one of said walls, and said rotor positioned adjacent an other of said walls.

11. The fiber loading apparatus of claim 1, said reactant gas supply comprising a carbon dioxide gas supply.

12. An apparatus for loading fibers in a fiber suspension with calcium carbonate, comprising:

a housing having an inlet and an accept outlet;

a rotatable distribution cross within said housing, said distribution cross including a plurality of radially extending paddles, said distribution cross having an axis of rotation;

a rotor and stator assembly positioned within said housing radially outside of said distribution cross, including a rotor and stator in opposed relationship defining a gap therebetween, said gap being between approximately 0.5 mm and 100 mm;

a toothed ring interposed between said distribution rotor and said rotor and stator assembly, said toothed ring having a plurality of teeth extending generally parallel to said axis of rotation and spaced apart from each other, said toothed ring and said rotor and stator assembly defining a gas ring therebetween; and a reactant gas supply fluidly coupled with said gas ring.

13. The fiber loading apparatus of claim 12, further including a rotatable input shaft, each of said distribution member and said rotor being coupled with and driven by said input shaft.

14. The fiber loading apparatus of claim 13, said distribution member comprising a distribution cross including at least 2 to 8 radially extending paddles, each of said distribution cross and said rotor being generally concentric with said input shaft.

15. The fiber loading apparatus of claim 12, said inlet comprising an inlet pipe and said distribution member positioned generally concentric with said inlet pipe.

16. The fiber loading apparatus of claim 12, said distribution member having an axis of rotation, and said toothed ring being annular shaped with a plurality of teeth extending generally parallel to said axis of rotation and spaced apart from each other.

17. The fiber loading apparatus of claim 16, said teeth having a generally rectangular cross-sectional shape.

18. The fiber loading apparatus of claim 12, said reactant gas supply coupled with said housing and in fluid communication with said gas ring at a plurality of locations.

19. The fiber loading apparatus of claim 18, including a control valve coupled with said reactant gas supply for controlling at least one of a pressure and flow rate of reactant gas into said gas ring.

20. The fiber loading apparatus of claim 12, said housing including two annular shaped walls, said stator and said toothed ring coupled with one of said walls, and said rotor positioned adjacent an other of said walls.

21. The fiber loading apparatus of claim 12, said reactant gas supply comprising a carbon dioxide gas supply.

* * * * *

UNITED STATES PATENT AND TRADEMARK OFFICE

CERTIFICATE OF CORRECTION

PATENT NO. : 6,673,211 B2
DATED : January 6, 2004
INVENTOR(S) : Doelle

It is certified that error appears in the above-identified patent and that said Letters Patent is hereby corrected as shown below:

Column 5,
Line 17, please delete “0.5 mm”, and substitute therefore -- 25 mm --.

Column 6,
Line 14, please delete “0.5 mm”, and substitute therefore -- 25 mm --.

Signed and Sealed this

Twenty-third Day of November, 2004

JON W. DUDAS
*Director of the United States Patent and Trademark Office*